US005181650A

United States Patent [19]

Hollander et al.

[11] Patent Number: 5,181,650

[45] Date of Patent: Jan. 26, 1993

[54] TRANSFORMABLE CARTON

[75] Inventors: Milton B. Hollander, Stamford; David R. Jacobs, Norwalk, both of Conn.

[73] Assignee: Omega Engineering, Inc., Stamford, Conn.

[21] Appl. No.: 670,238

[22] Filed: Mar. 15, 1991

[51] Int. Cl.[5] ..... B65D 5/32

[52] U.S. Cl. ..... 229/103; 206/44 R; 206/457; 229/120.011

[58] Field of Search ..... 206/44 R, 45.11, 45.12, 206/457; 229/23 R, 23 BT, 101, 103, 120.01, 120.011, 120.09, 120.012

[56] References Cited

U.S. PATENT DOCUMENTS

| | | | |
|---|---|---|---|
| 2,324,436 | 7/1943 | Snyder | 206/45.11 |
| 2,502,561 | 4/1950 | Ebert | 206/45.12 |
| 2,727,677 | 12/1955 | Zastrow | 229/120.01 |
| 3,087,666 | 4/1963 | Kitchell | 229/120.011 |
| 3,172,530 | 3/1965 | Grabosky et al. | 206/45.11 |
| 3,365,109 | 1/1968 | Kessler et al. | 229/120.01 |
| 3,474,949 | 10/1969 | Shine | 229/103 |
| 3,628,718 | 12/1971 | Broyles | 229/23 R |
| 4,113,100 | 9/1978 | Soja et al. | 206/44 R |
| 4,256,223 | 3/1981 | Pawlowski | 206/45.11 |
| 4,618,090 | 10/1986 | Cortellucci | 229/120.09 |

FOREIGN PATENT DOCUMENTS

| | | | |
|---|---|---|---|
| 1049299 | 1/1959 | Fed. Rep. of Germany | 206/45.12 |

*Primary Examiner*—Gary E. Elkins

*Attorney, Agent, or Firm*—Bruce E. Hosmer; Howard S. Reiter

[57] ABSTRACT

Collapsible box-like cartons of the type constructed to fold flat for storage and to be unfolded to form a rigid carton for shipping purposes are provided with secondary hinge and removable sections which thereby enable such cartons to be transformed from their first substantially rectangular geometric shape in which they are used as shipping cartons to a second useable shape so that they can be recycled for other purposes.

4 Claims, 7 Drawing Sheets

TRANSFORMABLE CARTON

This invention relates generally to cartons and containers of the type commonly used for packaging of goods, and more specifically relates to containers capable of being converted from a first shape to a second shape so that they may be reused for other purposes.

Containers formed from flat sheets of carton stock, which are cut to shape and creased along fold lines so that they may be bent and folded to form a three-dimensional shape composed of a plurality of integrally attached planar sidewalls, are well known in the container art. When such containers have served their intended purpose and it becomes necessary to dispose of them, it is common to disengage any fastening or detent means which retain the side walls in their three-dimensional shape, so that they may be flattened or otherwise reduced in bulk for convenient and economical disposal. However, in view of growing environmental concerns, as well as the reasonable desire to reduce waste wherever and whenever possible, it is now considered preferable to recycle the materials from which the containers are formed. At this time, the choice of recycling is often unavailable, due to a limited number of recycling centers, distance from the recycling plant, economic considerations involving the quantity of material to be recycled, and the like. As a preferable alternative, this invention proposes to permit the reuse of container products which might otherwise be destroyed or discarded, by constructing them so that they may be reconfigured easily to perform alternative ongoing functions, after their use for packaging purposes has been completed.

Accordingly, it is an object of this invention to provide a container formable of carton stock, which can be converted readily from a first configuration having a first use, to a second configuration having a second use.

It is a further object of this invention to provide a convertible container which can be produced easily and economically.

It is still another object of this invention to provide a convertible box which can be converted simply and conveniently from a first form to a second form.

A feature of this invention is a container having a plurality of sidewalls which can be arranged in a first configuration to form a three-dimensional shape in the form of a rectangular solid having an accessible interior space conforming to the exterior shape, and can further be arranged in a second configuration having a different function, by displacement of portions of said sidewalls.

These and other and further objects, features and advantages of this invention will be made apparent to those having skill in this art by the following specification and the accompanying drawings, in which.

Figure 8:
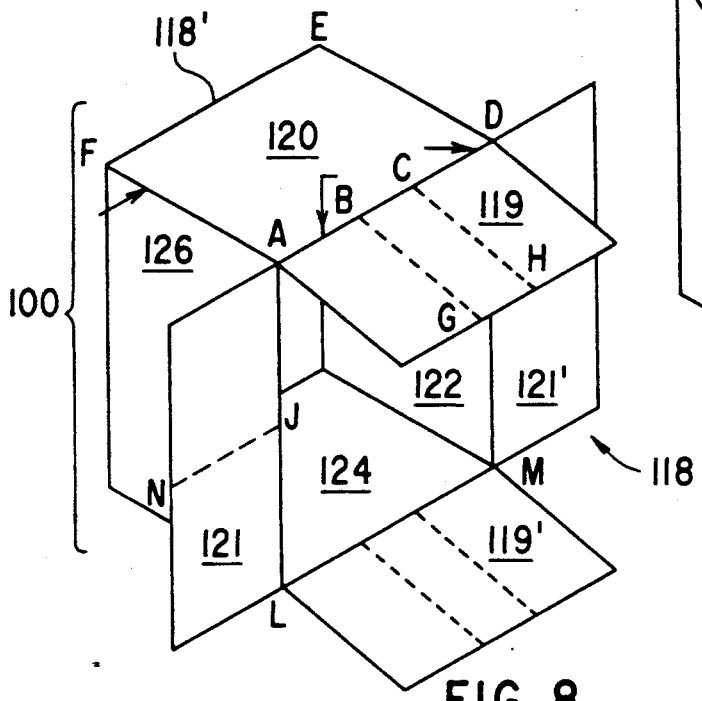
FIG. 8 is a pictorial representation of a second embodiment of this invention, showing a container comprising integrally interconnected sidewalls defining a three-dimensional rectangular solid having six sides when in a first configuration, and defining a form of side chair or stool when portions of certain sidewalls are displaced from the first position to a second position.
Figure 9:
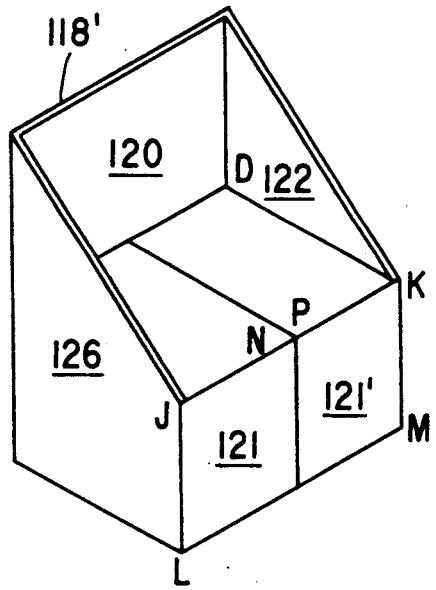
FIG. 9 is a pictorial representation of the container of FIG. 8, after portions of the sidewalls have been displaced to a second position to define a form of side chair or stool.
Figure 12:
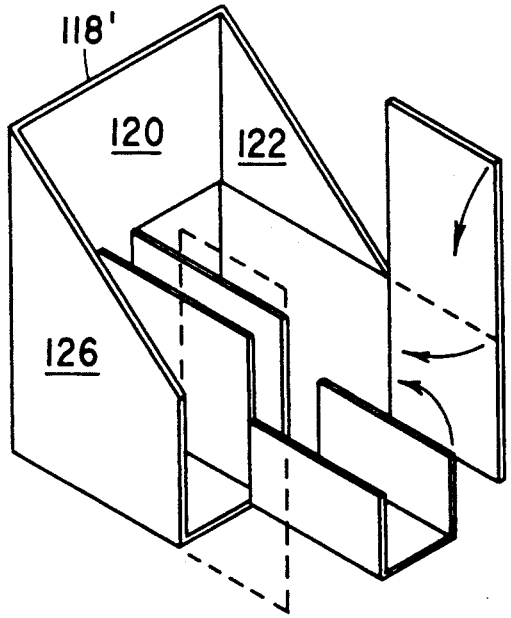
Figure 10:
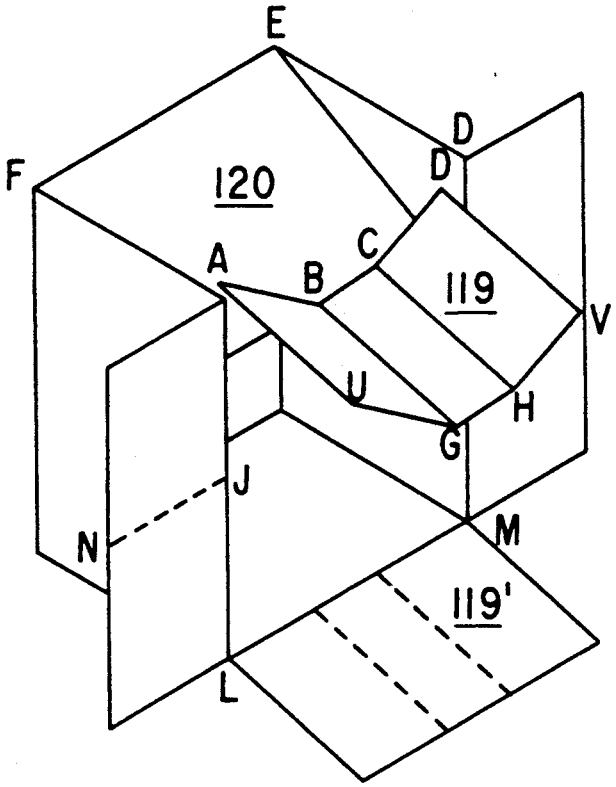
Figure 11:
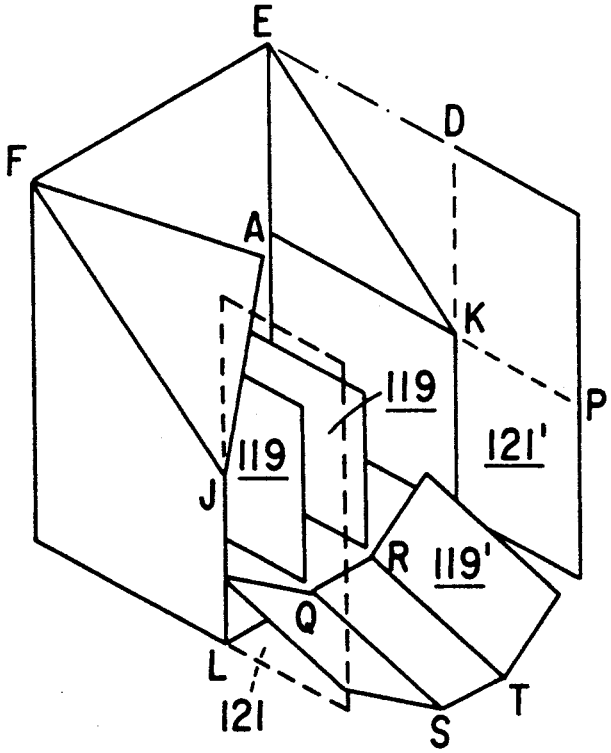
Figure 13:
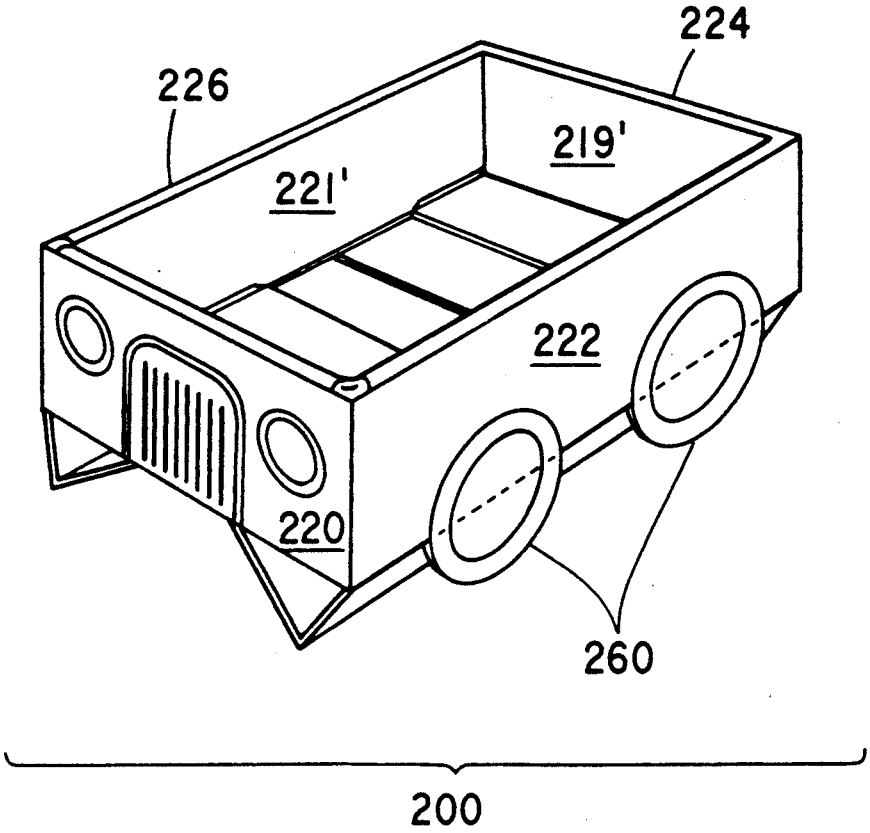
Figure 14:
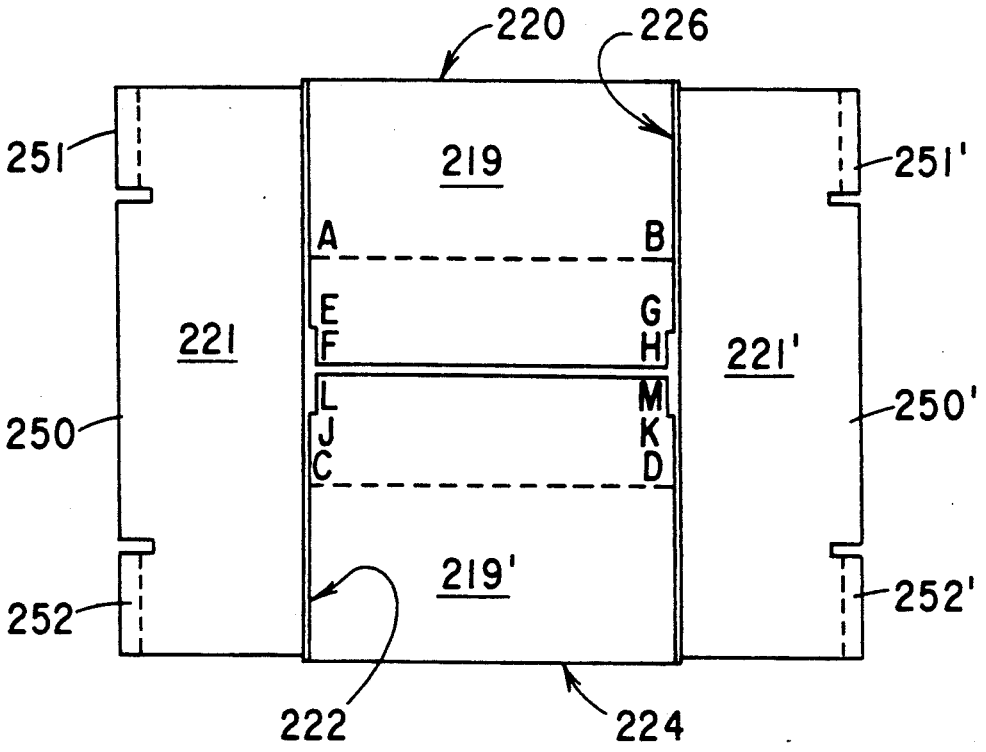
Figure 15:
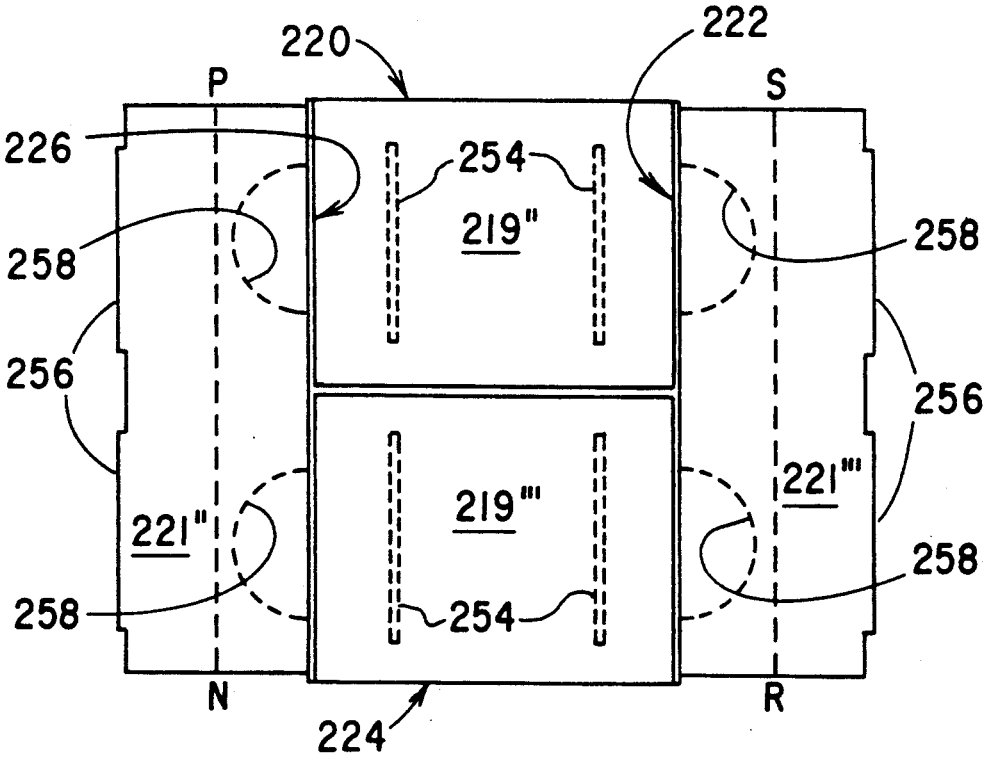
Figure 16:
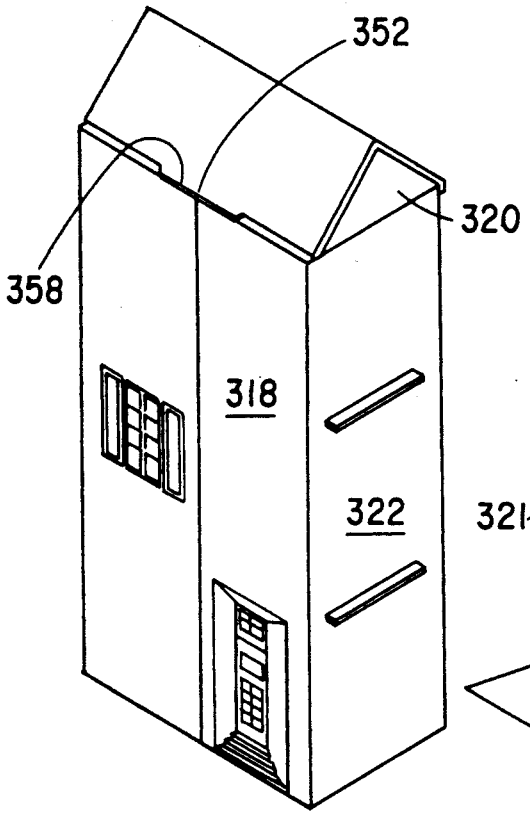
Figure 17:
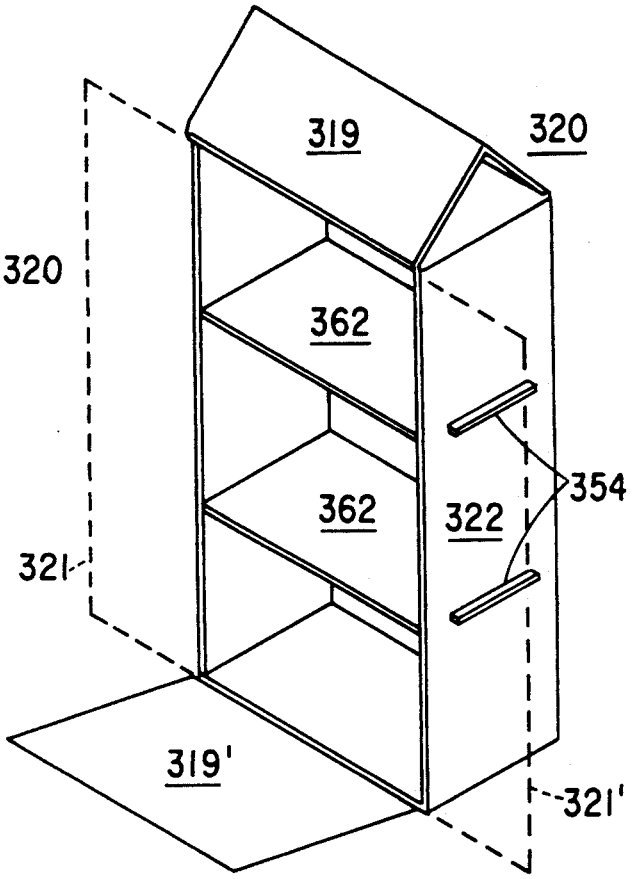
Figure 18:
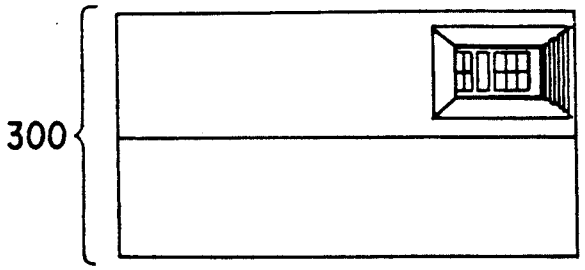
Figure 19:
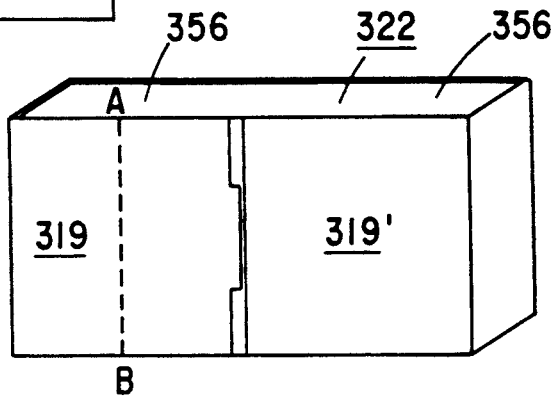

FIGS. 10, 11, and 12 are pictorial representations of the sequence of steps followed when the sidewalls of FIG. 8 are displaced into the position shown in FIG. 9;

FIG. 13 is a pictorial representation of a third embodiment of this invention, showing the second configuration of a container defining a form of toy cart after portions of certain sidewalls have been displaced into the second configuration from a first configuration in which a container comprising integrally interconnected sidewalls defines a hollow enclosed three-dimensional rectangular solid having six sides;

FIGS. 14 and 15 are plan views showing the top and the bottom, respectively, of the container of FIG. 13 in its first configuration, with the side portions of the top and bottom sidewalls partially opened;

FIG. 16 is a pictorial representation of a fourth embodiment of this invention, showing the second configuration of a container defining a form of toy house after portions of certain sidewalls have been displaced into the second configuration from a first configuration in which a container comprising integrally interconnected sidewalls defines a hollow enclosed three-dimensional rectangular solid having six sides;

FIG. 17 is a pictorial representation of the reverse side of the embodiment of FIG. 16, in a preliminary stage of displacing the sidewalls from the first configuration to the second configuration;

FIG. 18 is a plan view of the front side of the embodiment of FIG. 16, shown in its first configuration; and FIG. 19 is a pictorial representation of the rear side of the view shown in FIG. 18, after portions of the rear sidewall have been removed.

Figure 1:
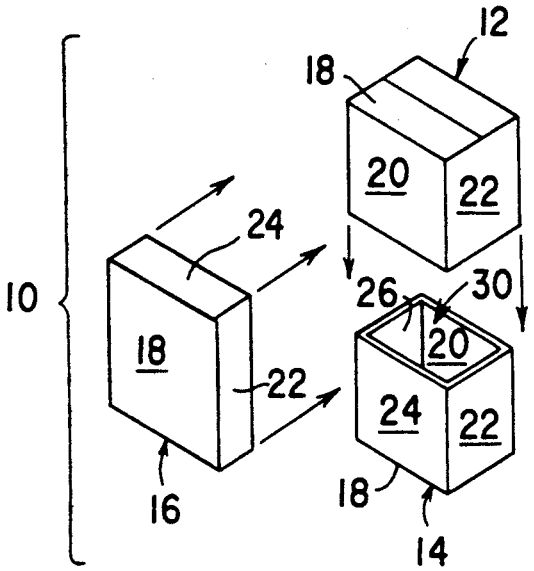
FIG. 1 is a pictorial representation of a first embodiment of this invention, showing a container comprising three open-sided receptacles aligned for nesting in a first position to form a closed packaging container.

Referring now more particularly to the drawings, the embodiment illustrated in FIG. 1 may be seen to comprise a container 10 formed of three open-sided receptacles 12, 14 and 16 which are dimensioned to nest in a variety of configurations to perform different functions. The receptacles may be formed readily of ordinary carton stock or other suitable material in any well-known manner. Each one includes a base sidewall 18, and four upstanding sidewalls 20, 22, 24 and 28 disposed in substantially rectangular array, in planes parallel to a central longitudinal axis, around the peripheral edges of the base, to define a five-sided receptacle having one open side 30.

Two of the receptacles, 12 and 14, have base sidewalls 18 of substantially identical dimensions, so that their central longitudinal axes may be substantially coaxially aligned with the open sides 30 abutted against each other to form a closed container in the shape of a three-dimensional rectangular solid. The base 18 of the third receptacle 16 is dimensioned to position its upstanding sidewalls in close surrounding and confining relationship with the base sidewalls 18 and two of the opposed upstanding sidewalls 20, 24 of each of the two receptacles 12 and 14. Accordingly, receptacles 12, 14 may be nested within receptacle 16 in telescopic relationship so that the confining effect of the outer receptacle 16 maintains receptacles 12 and 14 in aligned relationship, forming a closed container suitable for packaging various goods and articles.

It is a feature of this invention that the "nesting" configuration of receptacles 12, 14 within receptacle 16 represents only a first position of the elements of the container 10. As shown clearly in FIG. 2, the relationship among the various sidewalls may be altered readily by moving them to a second position to create a new configuration. In the second position shown in FIG. 2, the two receptacles 12, 14 are maintained in parallel side-by-side relationship with the open sides 30 exposed and accessible for use as bins to receive, for example, two different types of waste material for recycling purposes.

Figure 2:
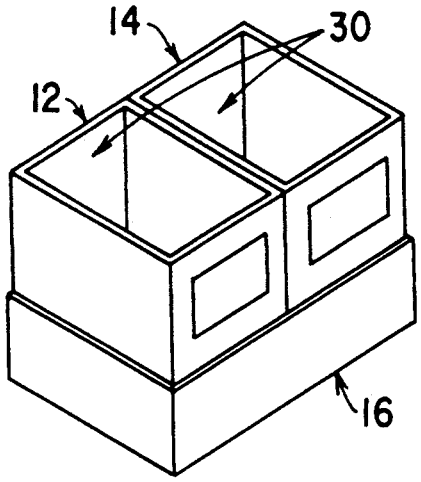
FIG. 2 shows the nesting receptacles of FIG. 1 after they have been arranged in a second position to form an open-sided two compartment container.
Figure 3:
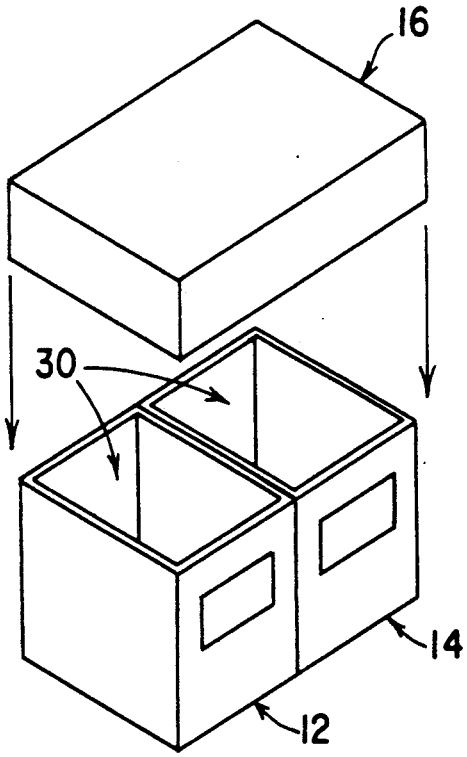
FIG. 3 is a pictorial representation of the receptacles of FIG. 1 after they have been arranged in a third position to form an enclosed two-compartment container suitable for storage or other packaging purposes.

A further feature of this embodiment of the invention is illustrated in FIG. 3, wherein it is shown that the receptacle member 16 may be used as a cover to close and maintain the receptacle members 12 and 14 in parallel, side-by-side relationship, as an enclosed, two-compartment container. The configuration illustrated in FIG. 3 may be recognized readily as a reversal of the position of receptacle 16 from the initial position shown in FIG. 2.

In accordance with this invention, selection of suitable dimensions for the various sidewalls, to achieve the disclosed nesting relationships in the first and second positions, will be apparent, readily, to one having ordinary skill in the packaging art.

Figure 4:
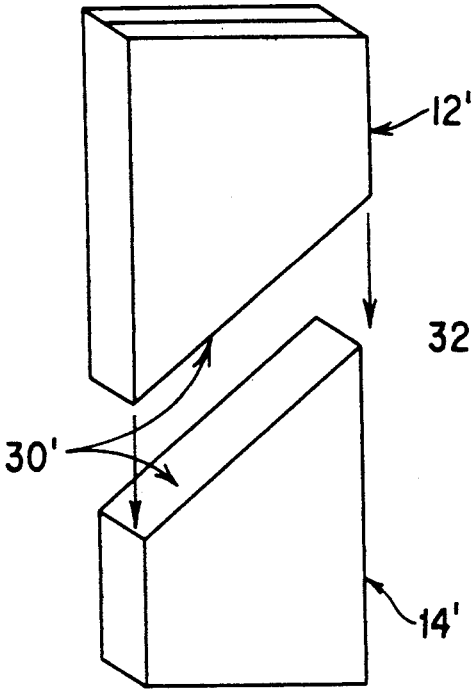
FIG. 4 is a pictorial representation showing two of the receptacles which are illustrated in FIGS. 1 and 2, having a slightly modified shape.
Figure 5:
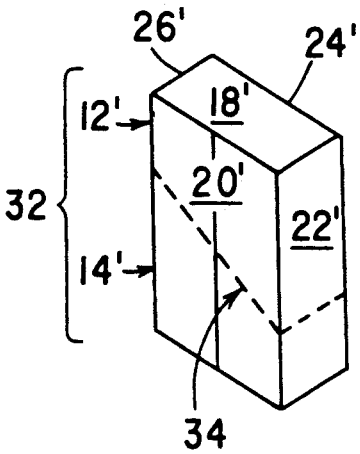
FIG. 5 is a pictorial representation of a further modified form of the invention illustrated in FIG. 4, showing how the two separate receptacles of FIG. 4 may be formed from a unitary one piece container.
Figure 6:
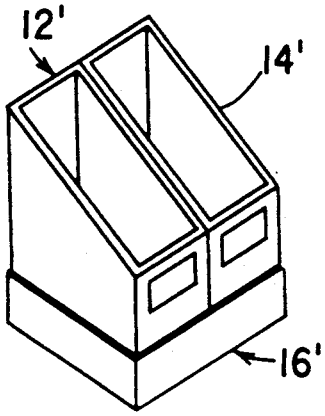
FIG. 6 is a pictorial representation of the modified receptacles of FIG. 4 nested to form a two compartment container in the manner of FIG. 2.

As suggested most clearly by the illustration of FIG. 4, it is not necessary for the purposes of this invention, for receptacles 12 and 14 to be formed with open sides which lie in planes normal to the central longitudinal axes of the receptacles; open sides lying in planes which are skewed at an angle to the central axis of the receptacle may be more desirable than the perpendicular orientation shown in FIGS. 1, 2 and 3, for certain uses. In FIG. 4, two receptacles 12' and 14' are shown having open sides 30' which are specifically skewed at an angle to the central longitudinal axis. Further, as illustrated in FIG. 5, the receptacle members 12' and 14' need not be initially formed as separate units. Specifically, receptacles 12' and 14' may formed initially as the opposite ends of a unitary closed six-sided rectangular container 32; by cutting the sides walls 20', 22', 24' and 26' along the cutting plane line 34 the unitary container will be separated readily into the two separate receptacles 12', 14'. In this regard, it should be noted that the open side of the nesting receptacle 16', into which receptacles 12' and 14' are inserted as shown in FIG. 6, may be oriented at any desired angle relative to the central longitudinal axis of the receptacle, without departing in any way from the spirit and scope of this invention.

Figure 7:
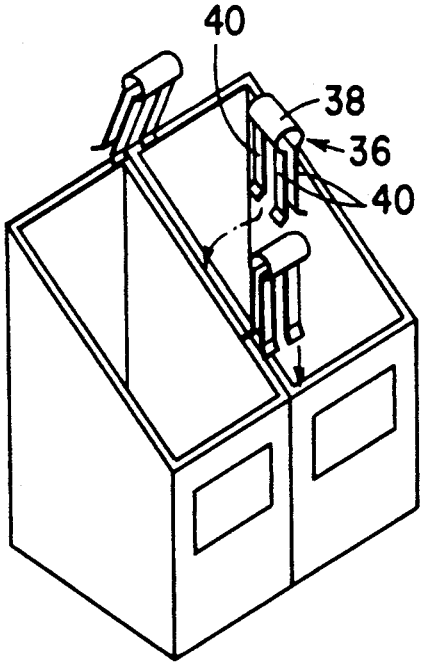
FIG. 7 is a pictorial representation showing how the modified receptacles of FIGS. 4 or 5 may be joined in an alternative form to provide a two-compartment container.

Referring now to FIG. 7, it may be seen that receptacles 12 and 14 or the modified receptacles 12' and 14' may be joined in side by side relationship to form an open-sided two compartment container independently of a third receptacle member such as 16 or 16'. In this embodiment coupling of the receptacles is achieved by means of resilient metallic coupling clips 36. Each clip 36 has a generally U-shaped cross-section including a resilient base portion 38, and two-pairs of parallel spaced-apart depending leg portions 40. The leg portions 40 straddle the junctions of the abutting sidewalls of two receptacles at the corners of the receptacles, and the resilient base 38 urges the legs of each pair toward each other so as to grip the carton stock (or other suitable material) of the sidewall between them. The resiliency retains the clip in its desired position, while the in-line configuration of the two pairs of legs in each clip retains the aligned sidewalls, which extend at right angles from the abutting sidewalls, in proper, aligned position. It will be recognized that the proper aligned position, for this purpose, is considered to correspond to the position in which the receptacles are maintained by the third receptacle element illustrate in FIGS. 2 and 6.

The embodiment of the invention disclosed in FIGS. 8 through 11 represents a container 100 of generally conventional shape, having sidewalls 120, 122, 124 and 126 arranged in upstanding rectangular relationship around the periphery of a pair of parallel, spaced-apart endwalls 118, 118'. As illustrated in FIG. 8, the endwalls 118, 118' are defined conventionally by a pair of end flaps 119, 119' and a pair of side flaps 121, 121' integrally formed with sidewalls 120, 122, 124 and 126.

When this conventional closed and closeable container has served its initial packaging and/or storage purpose, certain portions of the sidewalls, including the endwalls, may be displaced from their initial or first relative positions, to second relative positions, to alter the shape and function of the container. In accordance with this invention, as shown in FIGS. 8 and 10, sidewall 120 is separated from sidewalls 126 and 122, respectively, along lines FA and ED leaving it integrally coupled to rear endwall 118 as an integral hinge along line FE. End flap 119 is partially severed from sidewall 120 between points AB and CD, so that it remains attached to sidewall 120 by a portion of the original integral hinge between points B and C. Fold lines BG and CH are formed in end flap 119 as shown at right angles to hinge BC.

When elements 120 and 119 have been modified as described, element 120 is displaced about its integral hinge FE until it is in parallel abutting relationship with rear endwall 118'. The relative dimensions of 120 and 118' are selected in advance so that, in this position, the portion of integrally attached one flap 119 between fold lines BG and CH will lie in parallel abutting relationship against sidewall 124, at right angles to rear endwall 118, and the portions of flap 119 on either side of these fold lines will be folded at right angles to that portion so that they are standing upright at right angles to sidewall 124, as shown in FIG. 11.

As further illustrated in FIGS. 11 and 12, lower end, flap 119' is partially severed from lower sidewall 124 in a manner similar to the modification of upper end flap 119 and upper sidewall 120; that is, cuts are made along lines LQ and RM, leaving the two elements integrally attached along hinge line QR. The two portions of flap 119' on either side of foldlines QS and RT are then folded at right angles to the portion between the lines, and that portion is folded at right angles to the sidewall 124 along hinge QR, to bring lower end flap 119' upright into the position suggested by the arrow shown in FIG. 12.

After sidewall 120 has been separated from sidewalls 126 and 122 along lines FA and ED, these sidewalls are folded along diagonal lines FJ and EK which are positioned so that points J and K are located substantially in alignment with points U and V on the upstanding ends of upper end flap 119, to provide a desired shape for the sides of a seat or stool as disclosed herein. The right triangular corners defined by points FJA and EKD, are folded back into parallel abutting relationship with their associated sidewall, positioning the edges JA and DK in parallel alignment with bottom sidewall 124, thereby defining shoulders within the container, facing the surface of sidewall 124 in opposing relationship.

To complete the transformation of container 100 into a seat or stool, end flaps 121, 121' are partially severed from their respective sidewalls, 126, 122 along lines AJ and DK. Swinging the remaining portions of the flaps into their original closed positions about integral hinge lines JL and KM, as shown most clearly in FIG. 9, brings them into abutting and supported relationship with the upstanding ends of the upright portions of lower end flap 119'; finally, the upper portions of flaps 121, 121' are folded into the container about fold lines JN and PK, to bring the folded portions to rest in supported and abutting relationship on the upper edges of the upstanding portions of end flaps 119, 119', in generally parallel alignment with lower sidewall 124. It will be understood readily that, in this position, the eges JA and KD of flaps 121, 121' may be captured under the corresponding downwardly facing edges JA and KD of the inwardly folded triangular portions of sidewalls 126, 122. The seat formed by the inwardly folded portions of flaps 121, 121' accordingly will be captured and firmly supported between the upwardly facing edges of flaps 119, 119' and the downwardly facing shoulders JA and KD while they are captured between the inner surfaces of sidewalls 126, 122, and surrounded by the upwardly projecting portions of sidewalls 126, 120 and 122, to form a serviceable chair or stool.

In the third embodiment of this invention, illustrated in FIGS. 13, 14 and 15, a substantially conventional container 200 in the original form of a rectangular solid having six sides, as previously described herein, has been transformed into a form of toy cart by selective displacement of portions of the sidewalls. It can been seen in the partially opened top plan view of FIG. 14, that the top sidewall of the container is composed of a pair of side flaps 221, 221' and a pair of end flaps 219, 219', integrally coupled, as previously described, to two pairs of saidwalls, 226, 220, and 220, 224, respectively. The end flaps 219, 219' are provided with fold lines AB and CD which allow the portions coupled to sidewalls 220, 224 to be folded inwardly into the opening of the container until those portions are in parallel abutting relationship with the inner surface of the associated sidewall and the free ends extending beyond the fold lines are folded at right angles so that they lie in parallel abutting relationship with the sidewall, which defines the floor of the container (as shown in FIG. 15), composed of side flaps 221'' and 221''' and end flaps 219'' and 219'''.

Upper side flaps 221 and 221' are folded into the container similarly, until they are in abutting relationship with their associated sidewalls 222 and 226 so as to form an open-sided receptacle. Preferably, a tab 250, 250' is formed at the free end of each side flap 221, 221', by selectively removing an arbitrary short portion of the edge of each flap at the outer ends thereof, as indicated at 251, 252 and 251', 252'. The free ends of end flaps 219, 219' are similarly provided with notches by removal of short lengths of the edges at EF, GH, LJ and MK; these notches are dimensioned to cooperate with the spaces formed at 251, 252 and 251', 252' to allow tabs 250, 250' to enter into the space between the notches, when each of the upper end flaps and side flaps have been folded into the container, as described above.

Transformation of the container 200 from a package to a toy cart is continued by providing lower end flaps 219'', 219''' each with a pair of spaced apart slots 254 positioned parallel to, and a short distance inwardly from the adjacent sidewalls 222 and 226. The slots 254 are provided to receive mating tabs 256 formed along the free edges of lower side flaps 221'', 221''', as shown most clearly in FIG. 15. These flaps are further provided with longitudinal fold lines NP and RS positioned generally in the center of the width, between the free edges and the opposite edges, which are integrally attached to the adjoining sidewalls 226, 222. Each flap 221'', 221''' is also provided with a pair of semi-circular cuts 258 which allow the flaps to pivot about their integral hinges with the sidewalls, independently of the portions enclosed within the cutouts; accordingly, the portions within the cutouts may be displaced to position them in parallel aligned relationship with the adjoining sidewall, to form the lower portions of simulated "wheels" 260, shown in FIG. 13. To provide the cart with vertical support to maintain the cart above a support surface as though supported by the "wheels", side flaps 221'', 221''' are folded inwardly about fold lines NP, RS and pivoted relative to the adjoining sidewalls 226 and 222 until the tabs 256 are inserted into slots 254 to retain the folded flaps in triangular cross-sectional configuration with the apex of the triangular shape pointing downwardly. It should be understood, in this regard, that if desired, the cutouts 258 may be elminated, and the relative positions of fold lines PN, RS and slots 254 may be selected so that the portions of the flaps 221'', 221''' which are immediately attached to the sidewalls, will be retained in parallel aligned relationship with the sidewalls when tabs 258 have been inserted into slots 254, so that the "wheels" 260 may be merely printed on the surface of the flaps. Other suitable printed indicia on the outer surfaces of the walls of the container complete the appearance of a toy cart.

In the fourth embodiment of this invention shown in FIGS. 16 through 19, a substantially conventional container 300, as previously described herein, having suitable printed indicia on the outer surfaces thereof, has been transformed from its first configuration, into a second configuration representing a toy house, as shown most clearly in FIG. 16 which represents the front of the "house". The side of the house representing the rear, as shown in FIGS. 17 and 18, may be seen to comprise a pair of side flaps 321, 321' and a pair of end flaps 319, 319', as previously described with reference to the other embodiments herein. The side flaps 321, 321' shown in dotted lines in FIG. 17 may be removed if desired to form "floors" 362 which are fixed in place within the house by forming tabs 354 at the ends thereof which are inserted into slots 356 formed in the longitudinal sidewall 322. The "roof" of the house is formed by providing upper end flap 319 with a medial fold line AB intermediate its width and parallel to the edge of the integrally attached sidewall 320. A tab 352 at the free edge of flap 319 is provided to fit into a slot 358 formed at the intersection of the front sidewall 318 and the upper sidewall 320 when the flap has been folded along line AB to achieve the desired "peak" effect. For convenience, lower end flap 319' (shown in FIGS. 17 and 19) may be removed entirely. Alternatively, and consistent with elimination of waste to satisfy environmental concerns, lower flap 319 may be folded and retained within the container as previously described herein with reference to the embodiment illustrated in FIGS. 13 through 15. In this regard, it should be understood that side flaps 321, 321' may be retained within the body of the container 300, similarly if they are not removed for use as "floors".

Although a specific embodiment of this invention has been disclosed, it should be understood that various other and different forms and embodiments are possible within the scope of this disclosure and the following claims.

We claim:

1. A convertible container comprising:

a plurality of sidewalls formed of substantially planar carton stock;

said sidewalls being coupled together in a first position to configure said container in the form of a three-dimensional body having an outer shape generally corresponding to a rectangular solid;

said container having an accessible hollow interior space enclosed by said sidewalls and substantially corresponding to the outer shape defined by said sidewalls, for storing articles therein, when said sidewalls are in said first position;

portions of certain of said sidewalls being displaceable from said first position to a second position relative to other of said sidewalls and being engageable with said other of said sidewalls in said second position for altering both the inner shape and the outer shape of said container to accommodate different uses of said container; wherein, said sidewalls of said container are arranged so that said container comprises a first, a second and a third open sided receptacle formed by said sidewalls, each receptacle being in the form of a three-dimensional rectangular solid having one open side and a central axis extending into the receptacle through the open side thereof, the open sides of said first and said second receptacles being disposed in abutting relationship in said first position such that said first and second receptacles together form said three-dimensional rectangular solid having said accessible hollow interior space;

said first and said second receptacles are received in nesting relationship within said third receptacle in said first position, with the central axes thereof each being disposed in substantially parallel relationship with each other and each lying in a plane which is substantially normal to the central axis of said third receptacle, to prevent separation of the abutting sides of said first and said second receptacles in the direction of the central axis thereof, and to maintain said accessible hollow interior space when said sidewalls are in said first position; and said first and said second receptacles are received in nesting relationship within said third receptacle in said second position with the open sides thereof rotated substantially ninety degrees from the said first position such that the central axes of said first and second receptacles are substantially parallel to the central axis of said third receptacle, and the open sides of said first and second receptacles are accessible from outside said third receptacle to define an open-sided container having two parallel side-by-side compartments.

2. A convertible container in accordance with claim 1, wherein:

the plane defined by the open side of said first and said second receptacle is skewed at an angle to the central axis of each receptacle such that when said open sides are abutted against each other in said first position, the central axes thereof lie in substantially parallel coaxial relationship.

3. A convertible container comprising:

a plurality of sidewalls formed of substantially planar carton stock;

said sidewalls being coupled together in a first position to configure said container in the form of a three-dimensional body having an outer shape generally corresponding to a rectangular solid;

said container having an accessible hollow interior space enclosed by said sidewalls and substantially corresponding to the outer shape defined by said sidewalls, for storing articles therein, when said sidewalls are in said first position;

portions of certain of said sidewalls being displaceable from said first position to a second position relative to other of said sidewalls and being engageable with said other of said sidewalls in said second position for altering both the inner shape and the outer shape of said container to accommodate different uses of said container; wherein, said container comprises a first, a second and a third open sided receptacle formed by said sidewalls, each receptacle being in the form of a three-dimensional rectangular solid having one open side and a central axis extending into the receptacle through the open side thereof, the open sides of said first and said second receptacles being disposed in abutting relationship in said first position such that said first and second receptacles together form said three-dimensional rectangular solid having said accessible hollow interior space;

said first and said second receptacles are received in nesting relationship within said third receptacle in said first position, with the central axes thereof each being disposed in substantially parallel relationship with each other and each lying in a plane which is substantially normal to the central axis of said third receptacle, to prevent separation of the abutting sides of said first and said second receptacles in the direction of the central axes thereof, and to maintain said accessible hollow interior space when said sidewalls are in said first position; and said first and said second receptacles are received in nesting relationship within said third receptacle in said second position with the open sides thereof rotated substantially ninety degrees from the said first position such that the central axes of said first and second receptacles are substantially parallel to the central axis of said third receptacle, and the open sides of said first and second receptacle are abutted against the sidewall of said third receptacle which is opposite the open side thereof to define an enclosed container having two parallel side-by-side compartments.

4. A convertible container comprising:

a plurality of sidewalls formed of substantially planar carton stock;

said sidewalls being coupled together in a first position to configure said container in the form of a three-dimensional body having an outer shape generally corresponding to a rectangular solid;

said container having an accessible hollow interior space enclosed by said sidewalls and substantially corresponding to the outer shape defined by said sidewalls, for storing articles therein, when said sidewalls are in said first position;

portions of certain of said sidewalls being displaceable from said first position to a second position relative to other of said sidewalls and being engageable with said other of said sidewalls in said second position for altering both the inner shape and the outer shape of said container to accommodate different uses of said container; wherein, said container comprises a first and a second open-sided receptacle formed by said sidewalls, each receptacle being in the form of a three-dimensional rectangular solid having one open side and a central axis extending into the receptacle through the open side thereof;

the open sides of said first and said second receptacles being disposed in abutting relationship and separably coupled together along the periphery of each open side thereof, in said first position such that said first and second receptacles together form said three-dimensional rectangular solid having said accessible hollow interior space;

said first and said second receptacles in said first position are disposed with the central axes thereof in substantially parallel coaxial relationship with each other;

said first and second said receptacles being separable and displaceable from the said first position to a second position in which the open sides thereof are rotated substantially ninety degrees from the said first position such that the central axes thereof are disposed in substantially parallel spaced-apart relationship, and the open sides of said first and second receptacles are positioned in parallel side-by-side relationship so that they are accessible from the outside, to define an open-sided container having two parallel side-by-side compartments;

said container further comprising at least a pair of resilient chip elements engaging at least one side wall of each of said receptacles to retain them in said side-by-side relationship.

* * * * *